US011103006B1

(12) United States Patent
Zhang

(10) Patent No.: US 11,103,006 B1
(45) Date of Patent: Aug. 31, 2021

(54) VAPORIZER DEVICE HAVE A ROTATING ANNULAR KNOB

(71) Applicant: ShenZhen HuaKa Light Electronics Co., Ltd, Shenzhen (CN)

(72) Inventor: Qianghua Zhang, Shenzhen (CN)

(73) Assignee: ShenZhen HuaKa Light Electronics Co., Ltd, Shenzhen (CN)

( * ) Notice: Subject to any disclaimer, the term of this patent is extended or adjusted under 35 U.S.C. 154(b) by 0 days.

(21) Appl. No.: 17/241,090

(22) Filed: Apr. 27, 2021

(30) Foreign Application Priority Data

Apr. 16, 2021 (CN) ..... 202120778590.6

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 40/40*** | (2020.01) |
| ***A24F 40/60*** | (2020.01) |

(52) U.S. Cl.
CPC ..... *A24F 40/40* (2020.01); *A24F 40/60* (2020.01)

(58) Field of Classification Search
CPC ..... A24F 40/40; A24F 40/60; A24F 40/42
USPC ..... 131/328, 329
See application file for complete search history.

(56) References Cited

U.S. PATENT DOCUMENTS

| | | | | |
|---|---|---|---|---|
| 10,111,468 | B2 | 10/2018 | Fornarelli | |
| 10,334,888 | B2 | 7/2019 | Cameron et al. | |
| 10,888,125 | B2 | 1/2021 | Anderson et al. | |
| 2016/0095356 | A1* | 4/2016 | Chan | A24F 40/30 131/329 |
| 2017/0196266 | A1* | 7/2017 | Chen | A61M 15/0021 |
| 2020/0054074 | A1* | 2/2020 | Xiaojun | A24F 9/16 |
| 2020/0154768 | A1* | 5/2020 | Han | A24F 40/57 |
| 2020/0404965 | A1* | 12/2020 | Kerry | A24F 40/42 |

* cited by examiner

*Primary Examiner* — Hae Moon Hyeon
(74) *Attorney, Agent, or Firm* — True Shepherd LLC; Andrew C. Cheng

(57) ABSTRACT

A vaporizer device includes a vaporization unit for heating the smoke oil to generate an aerosol, a battery for supplying power to the vaporization unit, a housing connected to one end of the vaporization unit and accommodating the battery and a mouthpiece connected to the other end of the vaporization unit and used for inhaling the aerosol generated by the vaporization unit. The vaporizer device further includes a rotating part provided on the outside of the housing to rotate relative to the housing. By turning the rotating part, a user can relieve anxiety and stress. This indicates that the vaporizer device has an improved pressure relief effect. An annular knob is slidable toward a printed circuit board (PCB), so that a light-emitting diode (LED) lamp is controlled to change color.

7 Claims, 7 Drawing Sheets

VAPORIZER DEVICE HAVE A ROTATING ANNULAR KNOB

CROSS-REFERENCE TO RELATED APPLICATIONS

This application claims priority to Chinese Patent Application No. 202120778590.6 with a filing date of Apr. 16, 2021. The content of the aforementioned application, including any intervening amendments thereto, is incorporated herein by reference.

TECHNICAL FIELD

The present disclosure relates to the technical field of daily electronic equipment, and in particular to a vaporizer device.

BACKGROUND

The overall structure of a smoke oil vaporizer device includes smoke oil, a heating system, a power supply and a filter. The smoke oil is atomized into an aerosol with a specific odor for the user to inhale. The smoke oil includes nicotine, cannabidiol (CBD) or tetrahydrocannabinol (THC), and it can usually be added with flavorings and propylene glycol, etc. In a broad sense, the smoke oil vaporizer device refers to an electronic nicotine delivery system (ENDS), including various forms such as electronic cigarette, hookah and hookah pen. In a narrow sense, the smoke oil vaporizer device refers only to a portable electronic cigarette that is similar in appearance to a traditional cigarette.

The internal structure of the electronic cigarette on the market generally includes high-tech microelectronic devices such as an air switch, an intelligent control circuit, an intelligent ESMOKE chip, an ultrasonic vaporizer generator, a vaporizer cavity and a lithium-ion battery. Through the control of the modern microelectronics technology, high-tech humanized functions such as airflow induction, smoke simulation, aerosol temperature control and standby at any time are realized.

The vaporizer device in the prior art adopts a smooth shell structure. The structure is too simple to relieve the pressure of the user well. In addition, the existing vaporizer device has a single function and is not funny. To solve these problems, it is necessary to develop an innovative vaporizer device.

SUMMARY

In order to solve the problems of simple structure and single function of the vaporizer device in the prior art, the present disclosure aims to provide a vaporizer device.

To achieve the above objective, the present disclosure adopts the following technical solutions:

A vaporizer device, including a vaporization unit for heating smoke oil to generate an aerosol, a battery for supplying power to the vaporization unit, a housing connected to one end of the vaporization unit and used for accommodating the battery and a mouthpiece connected to the other end of the vaporization unit and used for inhaling the aerosol generated by the vaporization unit, where the vaporizer device further includes a rotating part provided on the outside of the housing and able to rotate relative to the housing.

Preferably, the rotating part may be an annular knob rotatably sleeved on the outside of the housing.

Preferably, the annular knob may receive a rotation resistance when rotating relative to the housing.

Preferably, the vaporizer device may further include a connector for connecting the housing and the vaporization unit; an accommodating cavity may be provided in the connector, and the annular knob may be rotatably sleeved on the outside of the connector.

Preferably, the vaporizer device may further include protrusions provided on an outer wall of the connector and elastically abutting against an inner wall of the annular knob; inner and outer sides of the annular knob may be engraved with tooth patterns.

Preferably, a side wall of the connector may be provided with a pair of oppositely arranged through holes; a tube body may be inserted through the through holes; the protrusions may be round beads, and there may be two round beads; the two round beads may be embedded in double ends of the tube body and may elastically abut against double ends of a spring embedded in the tube body.

Preferably, the vaporizer device may further include a light-emitting diode (LED) lamp provided on the outside of the housing; the annular knob may be able to slide along the connector to adjust a color displayed by the LED lamp.

Preferably, the housing may be provided therein with a printed circuit board (PCB) capable of controlling the color of the LED lamp to change; the PCB may be provided thereon with a start switch; when the annular knob slides toward the PCB, the start switch may be triggered to enable the PCB to control the color of the LED lamp to change.

Preferably, the housing may be provided therein with a bracket for fixing the PCB and a connecting piece coupled with the start switch of the PCB; an end of the connecting piece away from the bracket may be connected to the tube body; when the annular knob slides toward the PCB, the connecting piece may be driven by the tube body to trigger the start switch to enable the PCB to control the color of the LED lamp to change.

Preferably, a multi-functional button may be further provided on the outside of the housing.

Compared with the prior art, the vaporizer device provided by the present disclosure has the following beneficial effects:

1. A rotating part is provided on the outside of the housing of the vaporizer device, and the rotating part is able to rotate relative to the housing. In actual use, by turning the rotating part, a user can relieve anxiety and stress. This indicates that the vaporizer device has improved pressure relief effect.

2. An LED lamp is provided on the outside of the housing of the vaporizer device, and it is located at the end of the housing away from the mouthpiece. When the user inhales through the mouthpiece, a key switch controls a heating circuit inside to be turned on, and the LED lamp 9 lights up to inform the user that the vaporizer device is in working state.

3. When the annular knob slides toward the PCB, the tube body drives the connecting piece to trigger the start switch to enable the PCB to control the LED lamp to change color. By changing the color of the LED lamp, it is convenient for a color-weak user to use the vaporizer device, which improves the fun and practical value of the vaporizer device.

Those not mentioned in the present disclosure are the same as the prior art or may be implemented by the prior art. The present disclosure solves the problem that the structure of the existing vaporizer device is too simple to relieve the pressure of the user well. In addition, by sliding the annular knob to control the LED lamp to change color, the present disclosure improves the fun of the vaporizer device, and makes it convenient for the color-weak user to use the vaporizer device.

Figure 1:
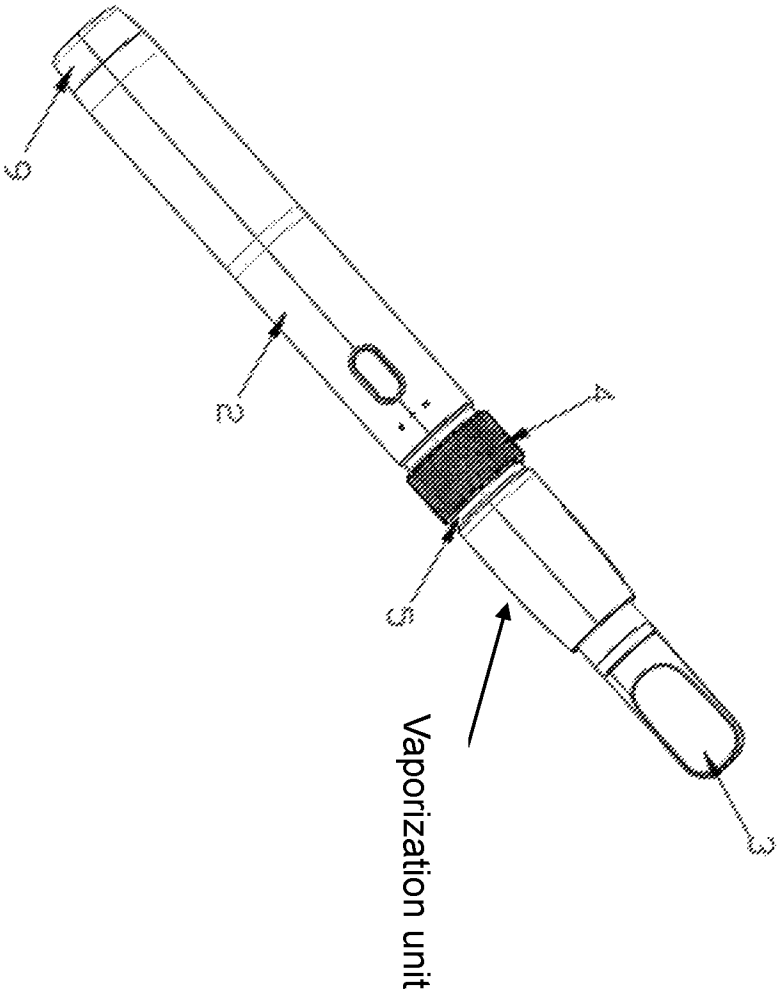
FIG. 1 is a stereoscopic view of a vaporizer device according to the present disclosure.

Reference Numerals: 1. battery; 2. housing; 3. mouthpiece; 4. annular knob; 5. connector, 6. tube body; 7. spring; 8. round bead; 9. light-emitting diode (LED) lamp; 10. printed circuit board (PCB); 11. bracket; 12. connecting piece; 13. Y-shape bracket; 14. gear.

DETAILED DESCRIPTION

The technical solutions in the embodiments of the present disclosure are clearly and completely described below with reference to the accompanying drawings. Apparently, the described embodiments are merely a part rather than all of the embodiments of the present disclosure.

In the description of the present disclosure, it should be understood that orientation or position relationships indicated by terms such as "upper", "lower", "front", "rear", "left", "right", "top", "bottom", "inside" and "outside" are orientation or position relationships as shown in the drawings. These terms are merely intended to facilitate and simplify the description of the present disclosure, rather than to indicate or imply that the mentioned device or components must have a specific orientation or must be constructed and operated in a specific orientation. Therefore, these terms should not be understood as a limitation to the present disclosure.

Figure 2:
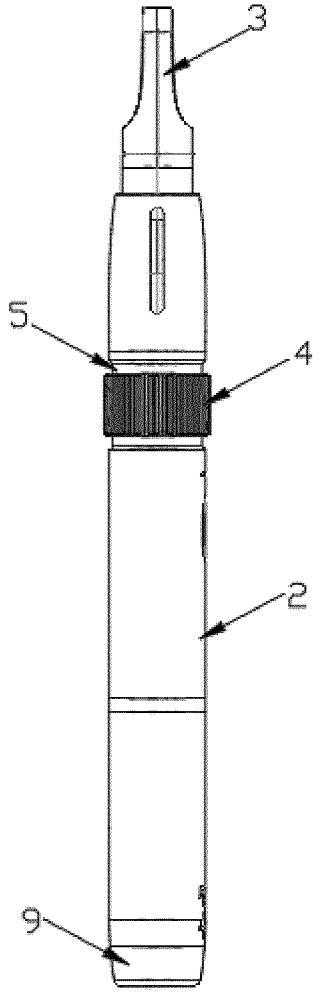
FIG. 2 is a front view of the vaporizer device according to the present disclosure.
Figure 3:
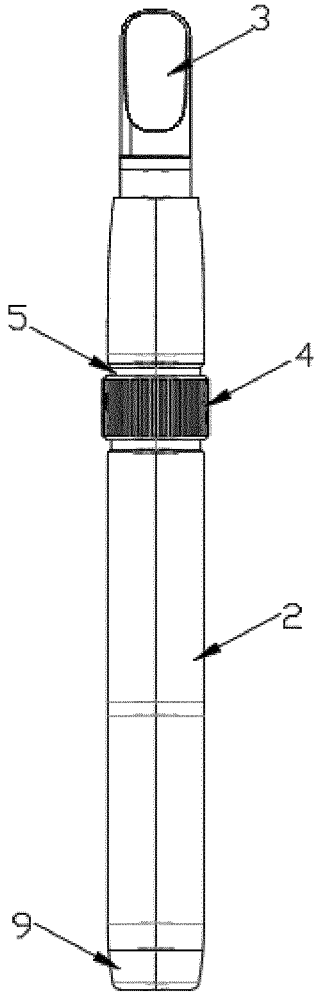
FIG. 3 is a lateral view of vaporizer device according to the present disclosure.

Referring to FIGS. 1 to 3, a vaporizer device includes a vaporization unit for heating smoke oil to generate an aerosol, a battery 1 for supplying power to the vaporization unit, a housing 2 connected to one end of the vaporization unit and used for accommodating the battery 1 and a mouthpiece 3 connected to the other end of the vaporization unit and used for inhaling the aerosol generated by the vaporization unit. It should be noted that the vaporization unit is designed to pump a nicotine solution in a matching tank, namely a cartridge, into a vaporizer cavity by an ultra-micro pump, and then apply a high-pressure ultrasonic wave with a frequency of 2.2 MHZ to atomize the solution into a droplet having a diameter of about 0.5-1.5 um for inhalation into the lungs. A built-in chip is provided with an airflow detector by which the vaporizer occurs only at the time of inhalation through the mouthpiece; the micro-processing chip also controls the working state of each component. The vaporizer device in the prior art relies on a high-tech intelligent chip and an air switch to control the output and working state of the aerosol. In the vaporizer device, a smoke liquid is transferred to a vaporizer cavity through a nickel foam, and the air switch is turned on by inhalation. The Esmoke intelligent chip is driven by a current of the battery 1 to control the vaporizer cavity to work, and a heating wire in the vaporizer cavity generates a high temperature to atomize the smoke liquid. Thus, an aerosol is produced to simulate a traditional one with a temperature.

In this embodiment, in order to improve the pressure relief effect of the vaporizer device, a rotating part is further provided on the outside of the housing 2 of the vaporizer device, and the rotating part is able to rotate relative to the housing 2. In actual use, by turning the rotating part, a user can relieve anxiety and stress. This indicates that the vaporizer device has improved pressure relief effect.

It should be noted that, referring to FIGS. 1 to 3, the rotating part is an annular knob 4 rotatably sleeved on the outside of the housing 2. In order to further improve the pressure relief effect of the annular knob 4, the annular knob 4 receives a rotation resistance when it rotates relative to the housing 2. In this embodiment, the rotatable connection of the annular knob 4 also relies on a connector 5 that connects the housing 2 and the vaporization unit. It should be noted that an accommodating cavity is provided in the connector 5 to accommodate a wire for connection, and the annular knob 4 is rotatably sleeved on the outside of the connector 5. The vaporization unit and the housing 2 may be detachably connected to the connector 5. For example, external threads are provided at both ends of the connector 5, and internal threads are provided at ends of the vaporization unit and the housing 2 correspondingly, such that the connector 5 may be screwed between the vaporization unit and the housing 2.

In order to achieve the rotation resistance for the annular knob 4 rotating relative to the connector 5, protrusions are provided on an outer wall of the connector 5, which elastically abut against an inner wall of the annular knob 4, and inner and outer sides of the annular knob 4 are engraved with tooth patterns. It should be noted that since the tooth pattern on the inner side of the annular knob 4 elastically abuts against the protrusion, the annular knob is able to be fixed at a stop position during rotation due to a friction between the tooth pattern and the protrusion. In addition, the tooth pattern on the outer side of the annular knob 4 increases a friction between a finger of a user and an outer wall of the annular knob 4.

Figure 4:
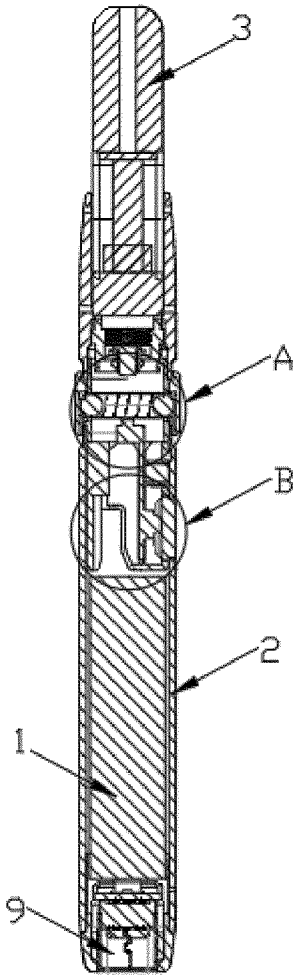
FIG. 4 is a sectional view of the vaporizer device according to the present disclosure.
Figure 5:
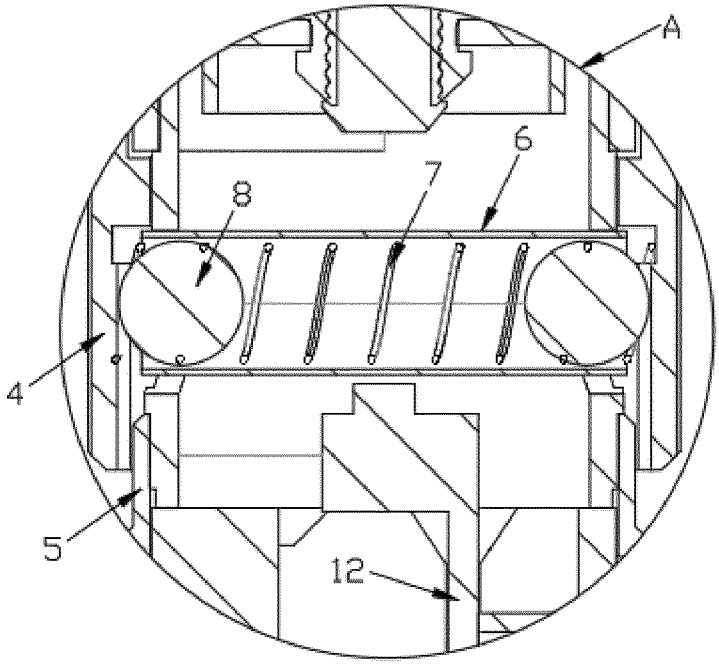
FIG. 5 is an enlarged view of A in FIG. 4.
Figure 6:
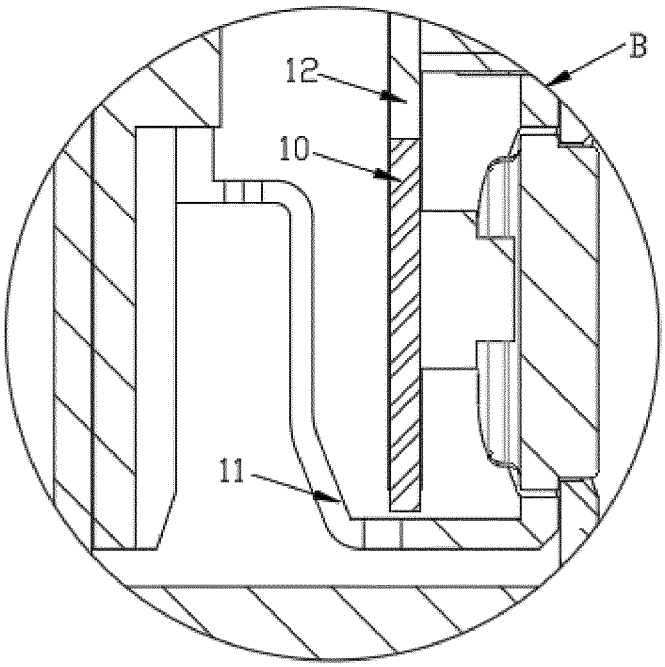
FIG. 6 is an enlarged view of B in FIG. 4.

Referring to FIGS. 4 to 6, a side wall of the connector 5 is provided with a pair of oppositely arranged through holes. A tube body 6 is inserted through the through holes. The protrusions are round beads 8, and there are two round beads. The two round beads 8 are embedded in double ends of the tube body 6 and elastically abut against double ends of a spring 7 embedded in the tube body 6. It should be noted that an end edge of the tube body 6 is provided with a limiting part for preventing the round beads 8 from being separated from the tube body 6. The spring 7 is in a compressed state, and has a tendency to extend outward. An extensional elastic force acts on the round beads 8 such that the round beads 8 always elastically abut against the inner wall of the annular knob 4. Through the engagement structure of the spring 7, the round beads 8 and the tooth patterns, there is a certain feel and force feedback when the annular knob 4 is moved by the finger of the user, making the annular knob similar to a rotatable watch case, thereby achieving the effect of anxiety and stress relief.

To inform the user about the working state of the vaporizer device, a light-emitting diode (LED) lamp 9 is provided on the outside of the housing 2 of the vaporizer device, and it is located at the end of the housing 2 away from the mouthpiece 3. When the user inhales through the mouthpiece 3, a key switch controls a heating circuit inside to be turned on, and the LED lamp 9 lights up to inform the user that the vaporizer device is in working state.

Among the users of the vaporizer device, there may be some who are color-weak. Color weakness is also referred to as anomalous trichromatism. People with color weakness have difficulty in distinguishing between colors. They can only see colors that are saturated, and distinguish changes in hue when there is a large difference in wavelength. The common forms of color weakness are red weakness (type A) and green weakness (type B), and blue weakness is rare. People with red weakness have poor ability to distinguish red, and people with green weakness have poor ability to distinguish green. Color weakness is most found in males. Generally, color weakness refers to the reduced ability to distinguish colors, and color blindness refers to the inability to distinguish certain colors or all colors. The common form of color blindness is red and green blindness. People who are red blind cannot distinguish red light, and people who are green blind cannot perceive green. Color blindness will undoubtedly affect people's life and work. Color weakness is mainly due to a weak color discrimination function, which is not so marked as color blindness. Although color-weak people can see colors seen by normal people, their ability to recognize colors is poorer. When the light is dark, some color-weak people feel almost the same as color-blind people or show color vision fatigue. Color blindness and color weakness are commonly caused by congenital factors.

Color blindness and color weakness are collectively referred to as color vision deficiencies, which are divided into two categories: congenital and acquired. Congenital color vision deficiencies are most common in red-green color blindness, which is a genetic disease that is inherited in a sex-linked recessive manner. That is, men with color blindness pass the genetic gene (X chromosome) through their daughters to their grandchildren (male). In other words, a red-green-blind grandpa passes the genetic gene on to his daughter, although the daughter does not appear to be color blind, she carries the genetic factor and passes it on to her son and makes him color blind. Only the daughter of a mother with color vision deficiency and a color-blind father will appear to be color-blind, and the ratio of color-blind males is five times larger than that of color-blind females.

Ordinary LED lamps only emit light of a single color, which may just falls into the color recognition blind spot of color-weak users. Therefore, in order to make the color displayed by the LED lamp 9 changeable for the color-weak users to recognize, the annular knob 4 is able to slide along the connector 5 to adjust the color displayed by the LED lamp 9. For example, the housing 2 is provided therein with a printed circuit board (PCB) 10 capable of controlling the color of the LED lamp 9 to change and the PCB 10 is provided thereon with a start switch. When the annular knob 4 slides toward the PCB 10, the start switch is triggered to enable the PCB 10 to control the color of the LED lamp 9 to change. Referring to FIG. 2, the housing 2 is provided therein with a bracket 11 for fixing the PCB 10 and a connecting piece 12 coupled with the start switch of the PCB 10. An end of the connecting piece 12 away from the bracket 11 is connected to the tube body 6. When the annular knob 4 slides toward the PCB 10, the connecting piece 12 is driven by the tube body 6 to trigger the start switch to enable the PCB 10 to control the color of the LED lamp 9 to change. By changing the color of the LED lamp 9, it is convenient for a color-weak user to use the vaporizer device, which improves the fun and practical value of the vaporizer device.

Further, a multi-functional button is provided on the outside of the housing 2 of the vaporizer device. In actual operation, the multi-functional button is pressed 5 times to switch the device on and off, 2 times to preheat and 3 times to adjust the mode (3 modes). After a built-in control chip of the PCB 10 receives a control signal generated by pressing the multi-functional button, it sends the control signal to a corresponding switch module, preheating module or mode adjustment module, and the corresponding module realizes a corresponding function according to the control signal. Besides, the PCB 10 is provided therein with a vibration module for feeding back various operations to the user in real time. The PCB 10 may further be provided with a Bluetooth module. The Bluetooth module is able to communicate with a mobile application (App) to monitor the intake and flavor of the smoke oil. These module functions may all be realized via a prior art.

It should be noted that the feel and force feedback to the finger moving the annular knob 4 in the present disclosure may be achieved by other alternative solutions. For example, in this embodiment, the round beads 8 may be replaced with other structure, such as a thimble. Of course, there are many other achievable solutions. These solutions are simple equivalent replacements based on the principle of the present disclosure, and should be included in the protection scope of the present disclosure. Two alternative solutions will be described in detail in FIGS. 7-9.

Figure 7:
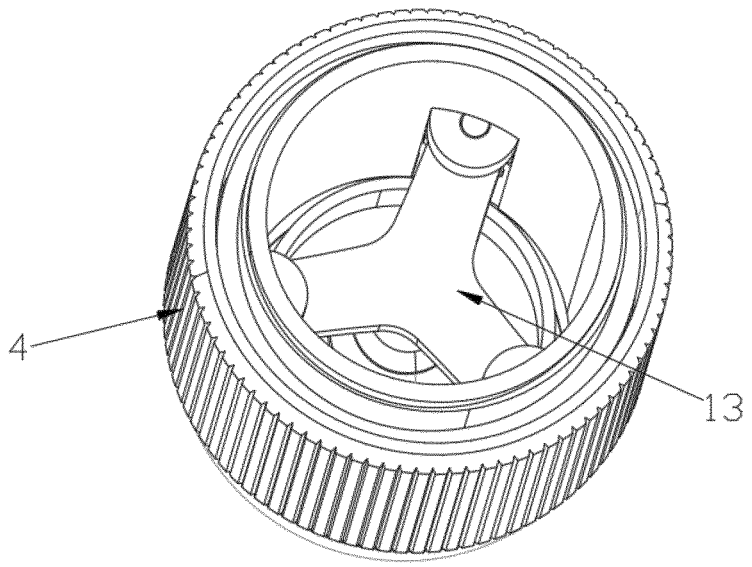
FIG. 7 is a schematic view showing a structure associate with a connector according to another embodiment of the disclosure.
Figure 8:
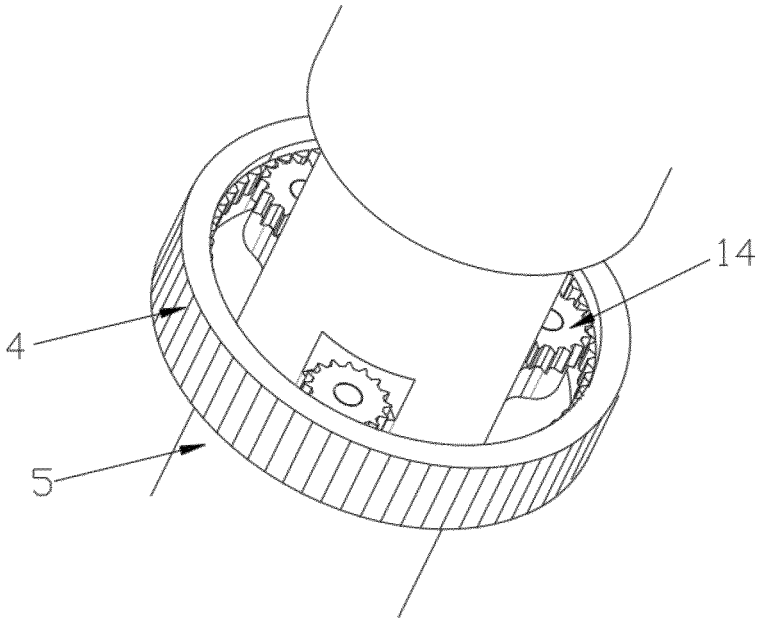
FIG. 8 is another schematic view showing the structure of FIG. 7.

As shown in FIGS. 7-8, a Y-shaped bracket 13 is arranged along an axis of the connector 5. The Y-shaped bracket 13 is vertical to the axis of the connector 5. Three holes are defined on side walls of the connector 5 corresponding to three ends of the Y-shaped bracket 13 respectively. Each end of the Y-shaped bracket 13 is in rotational connection to a gear 14. The gear 14 passes through the side wall of the connector 5 and extends outside the connector 5. The gear 14 is engaged with inner teeth of the annular knob 4. The annular knob 4 is in rotational couple with the connector 5 via the gear 14.

Figure 9:
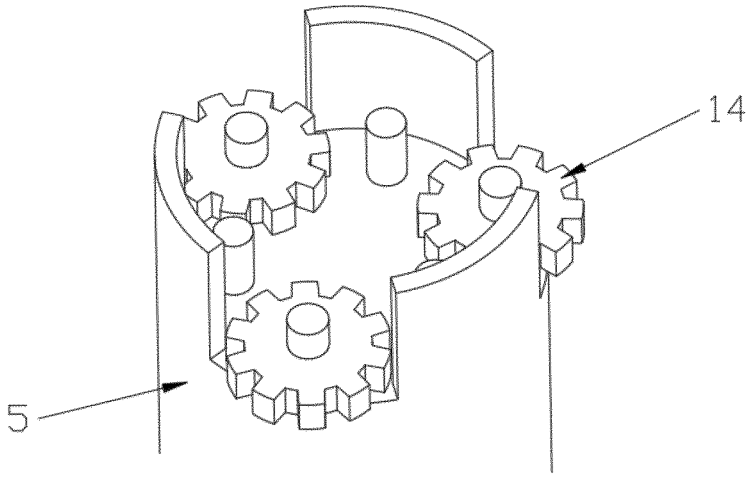
FIG. 9 is a schematic view showing another structure associate with the connector according to yet another embodiment of the disclosure.

As shown in FIG. 9, a plate body may be arranged along the axis of the connector 5 and the plate body is arranged vertical to the axis. Three notches are defined on the side walls of the connector. The gear 14 is in rotational connection to a surface of the plate body. The gear 14 passes through the side wall of the connector 5 and extends outside the connector 5. The gear 14 is engaged with inner teeth of the annular knob 4. The annular knob 4 is in rotational couple with the connector 5 via the gear 14.

In the present disclosure, a rotating part is provided on the outside of the housing 2 of the vaporizer device, and the rotating part is able to rotate relative to the housing 2. In actual use, by turning the rotating part, a user can relieve anxiety and stress. This indicates that the vaporizer device has improved pressure relief effect. An LED lamp 9 is provided on the outside of the housing 2 of the vaporizer device, and it is located at the end of the housing 2 away from the mouthpiece 3. When the user inhales through the mouthpiece 3, a key switch controls a heating circuit inside to be turned on, and the LED lamp 9 lights up to inform the user that the vaporizer device is in working state. When the annular knob 4 slides toward the PCB 10, the tube body 6 drives the connecting piece 12 to trigger the start switch to enable the PCB 10 to control the LED lamp 9 to change color. By changing the color of the LED lamp 9, it is convenient for a color-weak user to use the vaporizer device, which improves the fun and practical value of the vaporizer device.

The above described are merely preferred specific implementations of the present disclosure, and the protection scope of the present disclosure is not limited thereto. Any equivalent substitutions or changes made by those skilled in the art according to the technical solutions and concepts of the present disclosure within the technical scope of the present disclosure should be covered by the protection scope of the present disclosure.

It should be understood that in the description of the present disclosure, terms such as "central", "longitudinal", "transverse" "upper", "lower", "front", "rear", "left", "right" "vertical", "horizontal", "top", "bottom", "inside" and "outside" indicate the orientation or position relationships based on the drawings. They are merely intended to facilitate and simplify the description of the present disclosure, rather than to indicate or imply that the mentioned device or components must have a specific orientation or must be constructed and operated in a specific orientation. Therefore, these terms should not be construed as a limitation to the present disclosure. Moreover, the terms such as "first" and "second" are used only for the purpose of description and cannot be understood as indicating or implying relative importance or implicitly indicating the number of technical features denoted. Thus, features defined with "first" and "second" may explicitly or implicitly include one or more of the features. In the description of the present disclosure, unless otherwise specified, "a plurality of" means at least two.

In the description of the present disclosure, it should be noted that, unless otherwise clearly specified, meanings of terms "install", "connected with", and "connected to" should be understood in a board sense. For example, the connection may be a fixed connection, a removable connection, or an integral connection; may be a mechanical connection or an electrical connection; may be a direct connection or an indirect connection by using an intermediate medium; or may be intercommunication between two components. A person of ordinary skill in the art may understand specific meanings of the above terms in the present disclosure based on a specific situation.

What is claimed is:

1. A vaporizer device, used for vaporizing smoke oil, and comprising a vaporization unit for heating the smoke oil to generate an aerosol, a battery (1) for supplying power to the vaporization unit, a housing (2) connected to one end of the vaporization unit and used for accommodating the battery (1) therein, and a mouthpiece (3) connected to the other end of the vaporization unit and used for inhaling the aerosol generated by the vaporization unit, wherein the vaporizer device further comprises a rotating part provided on an outside of the housing (2), the rotating part being adapted to be operated by a user to rotate relative to the housing (2), wherein the rotating part is an annular knob (4) rotatably sleeved on the outside of the housing (2);

wherein the vaporizer device further comprises a connector (5) that connects the housing (2) and the vaporization unit to each other; an accommodating cavity is provided in the connector (5); and the annular knob (4) is rotatably sleeved on an outside of the connector (5), such that the annular knob (4) has an inner side facing an outer wall of the connector (5); and wherein the inner side of the annular knob (4) is formed with a toothed pattern and the connector (5) comprises protrusions that are movably provided on the outer wall of the connector (5) and are elastically biased to engage the tooth pattern of the inner wall of the annular knob (4).

2. The vaporizer device according to claim 1, wherein the annular knob (4) receives a rotation resistance when rotating relative to the housing (2).

3. The vaporizer device according to claim 1, the annular knob (4) has an outer wall that is formed with a tooth pattern.

4. The vaporizer device according to claim 1, wherein the outer wall of the connector (5) is provided with a pair of oppositely arranged through holes; a tube body (6) is inserted through the through holes; the protrusions comprise two round beads that are received in the tube body and are movably arranged at two ends of the tube body (6), a spring (7) being arranged in the tube body (6) and supported between the two round beads so as to elastically bias the two round beads to partially project out of the two ends of the tube body to engage the tooth pattern of the inner wall of the annular knob (4).

5. The vaporizer device according to claim 4, wherein the vaporizer device further comprises a light-emitting diode (LED) lamp (9) provided on the outside of the housing (2); and a color of the LED lamp (9) is changeable.

6. The vaporizer device according to claim 5, wherein the housing (2) is provided therein with a printed circuit board (PCB) (10) that is operable to change the color of the LED lamp (9); and wherein the annular knob (4) is slidable relative to the PCB (10) to selectively actuate the PCB (10) to change the color of the LED lamp (9).

7. The vaporizer device according to claim 6, wherein the housing (2) is provided therein with a bracket (11) for fixing the PCB (10) and a connecting piece (12) arranged in connection with the PCB (10), such that when the annular knob (4) slides toward the PCB (10), the connecting piece (12) is moved to actuate the PCB (10) to change the color of the LED lamp (9).

* * * * *